United States Patent [19]

Junker

[11] Patent Number: 4,577,440

[45] Date of Patent: Mar. 25, 1986

[54] CLAMPING DEVICE FOR A GRINDING RING

[76] Inventor: Erwin Junker, Talstrasse 78, D 7611 Nordrach/Baden, Fed. Rep. of Germany

[21] Appl. No.: 620,353

[22] Filed: Jun. 13, 1984

[30] Foreign Application Priority Data

Jun. 21, 1983 [DE] Fed. Rep. of Germany ..... 3322258
Feb. 16, 1984 [DE] Fed. Rep. of Germany ..... 3405556

[51] Int. Cl.[4] ..... B24B 41/04
[52] U.S. Cl. ..... 51/168
[58] Field of Search ..... 51/168, 169; 83/666, 83/676, 698; 403/360, 383

[56] References Cited

U.S. PATENT DOCUMENTS

| | | | |
|---|---|---|---|
| 2,497,217 | 2/1950 | Hall | 51/168 |
| 2,577,042 | 12/1951 | Speicher | 51/169 |
| 2,855,731 | 10/1958 | Stelmachowski | 51/169 |
| 3,613,472 | 10/1971 | Held | 51/168 |

FOREIGN PATENT DOCUMENTS

| | | | |
|---|---|---|---|
| 1167644 | 4/1964 | Fed. Rep. of Germany | 83/665 |
| 445807 | 9/1912 | France . | |

*Primary Examiner*—Roscoe V. Parker

[57] ABSTRACT

A clamping device for a grinding disk. The apparatus permits balancing and detachable fastening of a grinding ring on a driving shaft so that it excludes distorting and damaging of the grinding ring. For this purpose the supporting portion of a support flange of the driving shaft and the grinding ring are provided with interacting guiding means.

15 Claims, 6 Drawing Figures

CLAMPING DEVICE FOR A GRINDING RING

BACKGROUND OF THE INVENTION AND PRIOR ART STATEMENT

The invention consists of a clamping device for a grinding disc or, more specifically, a grinding ring. The device includes a clamping flange and a support flange which has positioned along the length of its supporting portion several radially protruding outer wedges whih are assigned to corresponding inner grooves within the borehole of the grinding ring. The present clamping device allows the balancing and detachable fastening of a grinding ring on a driving shaft so that it excludes distorting and damaging of the grinding ring. For this purpose the supporting portion of a support flange of the driving shaft and the grinding ring are provided with interacting guiding means, namely the aforementioned radially protruding outer wedges and cooperating inner grooves in the inner surface of the bore hole of the grinding ring.

Usually grinding rings have circular boreholes, and accordingly the support pivots of the clamping flange usually also have circular cross sections. Because of the high number of revolutions at which grinding rings are spinning, eccentricities in the grinding ring bearings produce dangerously high mass energy. When clamping a grinding ring, it is therefore important to avoid imbalance, i.e. exact centering is important. The known grinding rings therefore keep the play between the grinding ring borehole and the support pivot as small as possible. This avoids imbalance, however, it is accompanied by the disadvantage, that mounting a grinding ring on a support pivot is very difficult. Because of the tight play, the grinding ring deforms easily during mounting, and then, if possible at all, it takes much dexterity to undo the deformation without damaging the grinding ring during loosening it and trying again to slip it on. Many accidents during grinding are caused by practically invisible defects of the grinding ring, which occur during clamping in the clamping device.

Up to now, grinding disks for utilization on grinding machines have been slipped on a mandrel, respectively a supporting portion of the support flange, and have been fixed in their final position by means of, for instance, a clamping flange (U.S. Pat. No. 2,497,217). The main disadvantage of this known grinding ring clamping device consists therein, that it is difficult to mount the grinding disk on the support, because of its low tolerance. This is especially so, when the grinding disk is mounted slightly inclined on the support, which leads to deformation, whereafter subsequent mounting becomes impossible, and which furthermore leads to damage through distortion in the borehole of the grinding disk. This in turn leads to a further disadvantage of resulting in unbalanced spinning of the grinding disk.

There is another known clamping device for a grinding ring having the above mentioned disadvantages (FR-PS No. 445,807), where by means of wedges on the support flange and grooves in the grinding ring, supposedly a connection between these parts is made, which avoids bursting of the grinding ring.

SUMMARY OF THE INVENTION

The objective of the invention is to improve a clamping device for a grinding ring in such a way that it will be possible to easily mount a grinding ring, which can be produced at less cost than previously, with great play on the support flange, however, which is set to low play before tightening, in order to achieve good balancing and faultless whirling. This and other objects and advantages of the present invention will become evident from the description which follows.

According to the invention, this objective is accomplished by making the radius, which encloses the wedges, only a little smaller than the radius of the borehole of the grinding ring. Preferably, there are three evenly spaced wedges over the circumference.

A tolerance between the radii of a maximum of 5 $\mu$m is utilized. Preferably the opposed lateral edges of the wedges are bevelled.

The essential advantage of the clamping device especially for grinding rings of cubic boron nitride according to the invention lies therein, that at the here discussed tolerance in the range of 5 $\mu$m between the borehole of the grinding disk and the diameter of the supporting portion, although the grinding disk can no longer be mounted in the conventional method, it is easy with the solution of the invention to slip the grinding ring on the support portion, if the grooves of the grinding ring are directed toward the wedges on the circumference of the supporting portion. After attaining an axis perpendicular position of the grinding ring, all that is necessary is to rotate the grinding ring, so that the required fit is produced. In this position the grinding ring is clamped in the conventional way between the support flange and the clamping flange.

For an additional solution to the above mentioned objective, it is feasible that the cross sectional profile of each wedge is tapered and steadily increases from a smaller radius, which is smaller than the radius of the borehole of the grinding ring, to a greater radius, which is greater than the radius of the borehole.

Balancing is performed, whereby the wedges with their increasing outlines of their tapered cross-sectional profile fit like wedge-shaped slopes into the groove edges of the grinding ring, whereby the grinding ring, controlled by wedge-shaped slopes, is cammed and slides into the exact centering position. Because this kind of centering is accomplished without a tightly concentrical fit of the wedges in the grinding ring borehole, it is not necessary to use grinding rings having tight radial tolerances. Grinding rings with relatively wide radial tolerances can be produced comparatively inexpensively.

It is advantageous if each wedge increases from a smaller radius to a larger radius, in an outline of the shape of an arc of a circle, having the radius of which the center of the curvature is shifted laterally from the center of the supporting portion of the support flange by an eccentricity. This provides the additional advantage, that the centering of increasing grinding ring tolerances becomes somewhat decreased, and production by means of machining on conventional metal-cutting machines of wedge profiles of increasing cross sections can be performed without complicated special equipment.

Preferably the outline of each wedge increases against the rotational direction of the supporting portion.

Even with a clamping device of such a configuration, the rotational momentum is being transmitted by frictional contact from the support flange to the grinding ring fixedly clamped on it. Therefore those points, at the edges of the grooves, which the wedges are still touching from the centering, are released from the transfer of the rotational momentum, and the grinding ring could be running in both rotational directions, as far as that goes. However, in the normally not occurring case that for some reason the tightening of the grinding ring comes loose on the support flange, the detachment of the wedges from the edges of the grooves would cancel the centering, so that the immediately occurring great imbalance would have to lead to great damages or even accidents. The clamping device according to the invention prevents this, because even in such an emergency, centering would be maintained, and thereby the occurrence of imbalance is avoided. In both proposed solutions there are preferably three wedges evenly distributed over the entire circumference of the supporting portion of the support flange. Just as three legged chairs never wobble, a supporting portion having three equidistant wedges can make contact with three and only three equidistant points of a grinding ring.

The special advantage of this configuration of the clamping device consists therein, that it allows not only for easy mounting and exact centering, but also for inexpensive production of grinding rings, i.e. of grinding rings having greater radial tolerances.

BRIEF DESCRIPTION OF THE DRAWING

Further advantages result from the following explanation of execution examples of the invention by means of the enclosed drawings. The drawings illustrate the following.

DETAILED DESCRIPTION OF THE PREFERRED EMBODIMENTS

Figure 1:
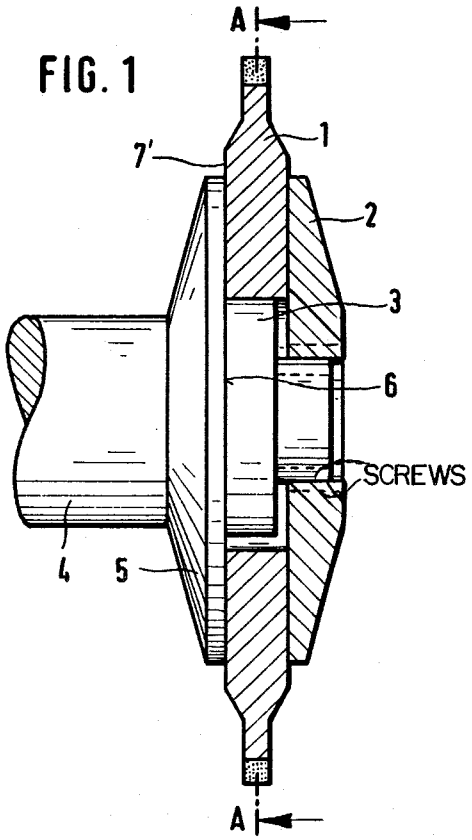
FIG. 1 is a partial sectional side view of a configuration of a grinding ring and a clamping device.

Referring now to the drawings, FIG. 1 illustrates a grinding ring 1 which is positioned with its borehole 10 on the supporting portion 3 of a clamping device on a driving shaft 4. The supporting portion 3 is a portion of the support flange 5, which has a flat ring surface as a clamping surface 6, which is positioned exactly at a right angle to the longitudinal axis of the driving shaft 4.

According to FIG. 1, the grinding ring 1 is being held on the supporting portion 3 by means of a clamping flange 2, which is screwed together with the support flange 5.

Figure 2:
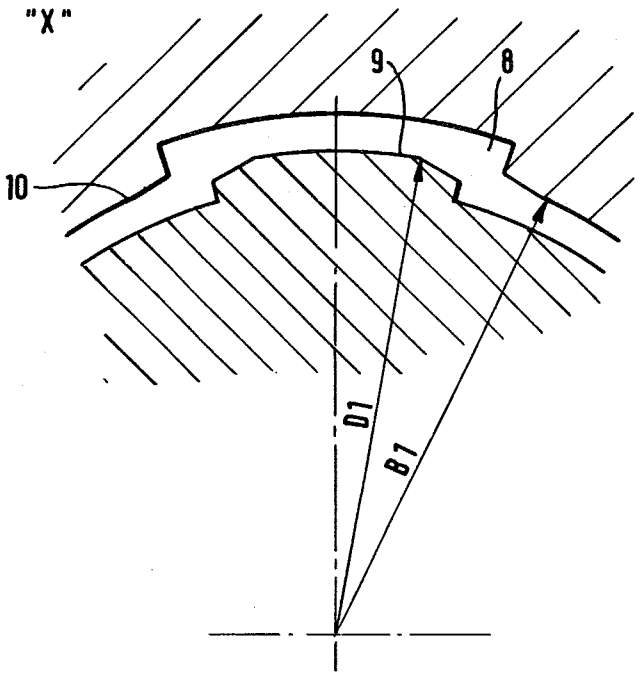
FIG. 2 is a detailed view of the area "x" in FIG. 3.
Figure 4:
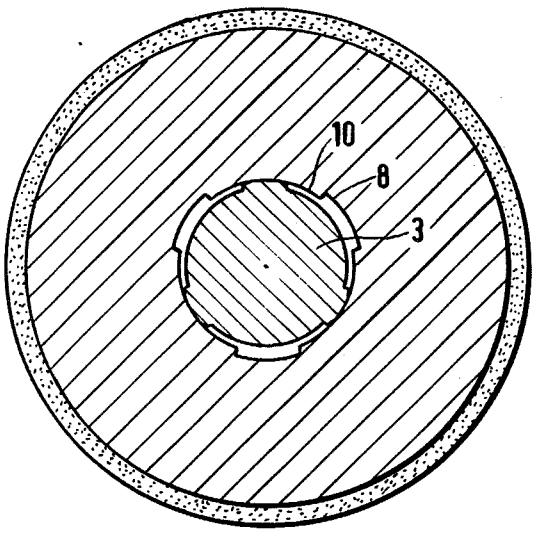
FIG. 4 is a view similar to FIG. 3, wherein, however, the grinding ring has been rotated against the supporting portion.
Figure 3:
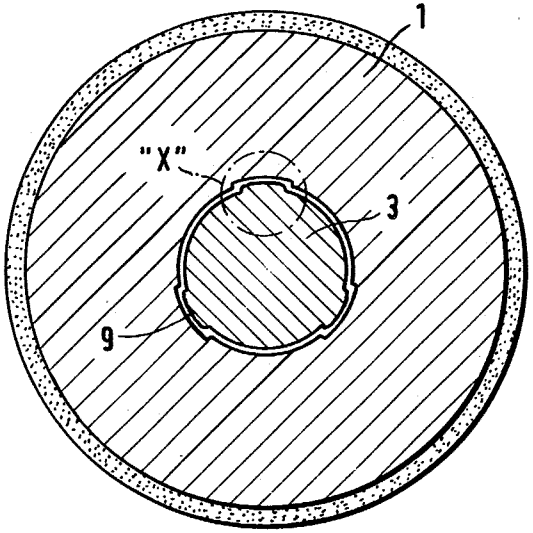
FIG. 3 is a section of a relative position between the grinding ring and the supporting portion of the support flange during installation of the grinding ring.

A bore 10 of the inner radius $B_1$ is provided, as clearly illustrated in FIGS. 2 to 4, with three equidistantly disposed axis parallel grooves 8, whereas on the circumference of the supporting portion 3, there are also three equidistantly disposed wedges 9, which are somewhat smaller than the grooves 8 of the grinding ring 1. The outer surface of the wedges 9, representing a cylindrical area, lie on the radius $D_1$, which is only a little smaller than the radius $B_1$. Thereby the grinding ring 1 can be mounted with much clearance on the supporting portion 3, so that the grinding ring and the supporting portion barely touch each other. At contact of the grinding ring 1 with its frontal area 7 against the support flange 5, the right angle between the grinding ring and the rotational axis is achieved exactly. Thereafter the grinding ring 1 is rotated in relation to the flange 5 with its supporting portion 3, until the position illustrated in FIG. 4 is achieved. Finally there follows the conventional fixation of the grinding ring on the clamping device, by means, for example, of the clamping flange 2 shown in FIG. 1.

Thereby it is guaranteed that the grinding ring rotates in exactly circular motion, and that the grinding ring cannot be damaged during installation, because installation is extremely simple, and furthermore the radius $D_1$ of the wedges 9 (see FIG. 2) is almost equal to the radius $B_1$ of the grinding ring borehole, whereby the balancing of the grinding ring on the supporting portion is maintained in the 5 $\mu$m-range. As shown, typically the opposed lateral edges of the wedges 9 are bevelled.

Figure 6:
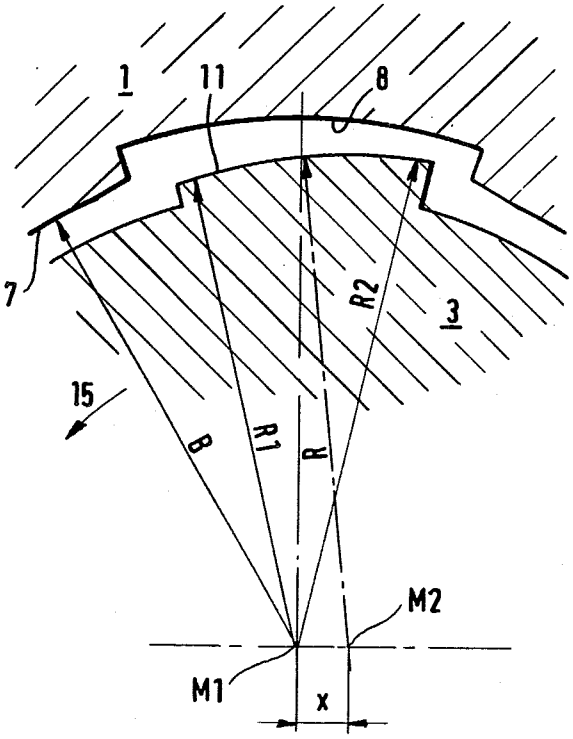
FIG. 6 is a detailed view of the mounting position in FIG. 5.
Figure 5:
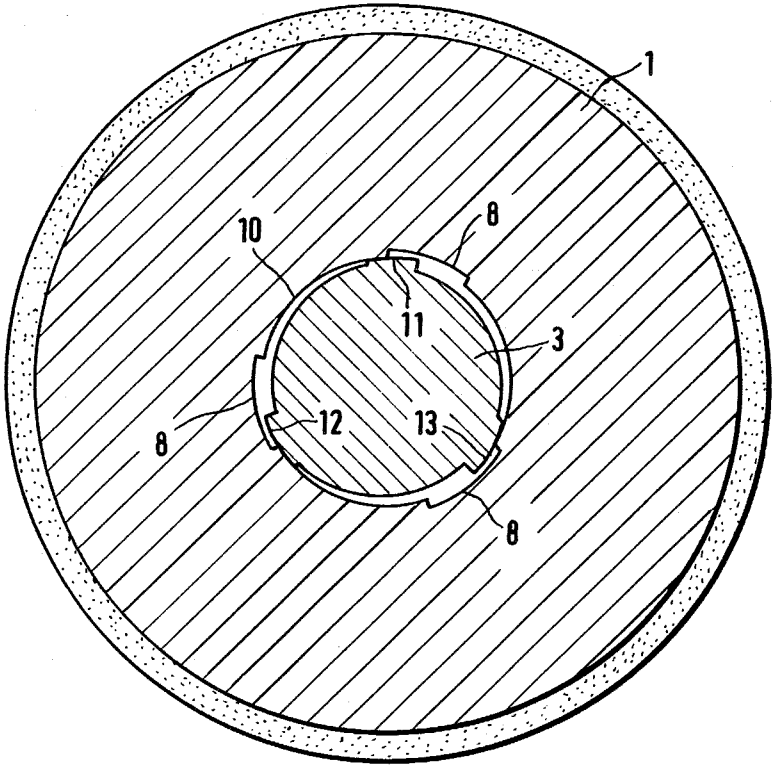
FIG. 5 is a section of the clamping device according to a further example of the invention, which is cut across the line A—A in FIG. 1, the centering position.

According to a further embodiment of the invention, the clamping device illustrated in FIGS. 5 and 6 also serves for the clamping of the grinding ring 1, which is made of boron nitride and suitable compounds, and which, as a matter of experience, is very sensitive to imbalance. The clamping device consists of the driving shaft 4, the support flange 5, the supporting portion 3, and the clamping flange 2.

When mounting a grinding ring 1, it is slid on the supporting portion 3 of the support flange 5, until the grinding ring 1 makes contact with the clamping surface 6. Thereafter the clamping flange 2 is slid on a pivot of the support flange 5, until it makes contact with the grinding ring 1. Finally the slip ring 1 is centered and the clamping flange 2, by means of screws, (indicated in FIG. 1 with dotted lines) is fixedly pulled onto the support flange 5. Thereby the grinding ring 1 is fixedly clamped down and is driven by the frictional contact between the flanges 2 and 5 by the revolutions of the driving shaft 4.

The grinding ring 1, according to FIGS. 5 and 6, is provided in the borehole 10 with three also axis parallel grooves 8, which are evenly spaced, i.e. positioned 120° from each other. The supporting portion 3 of the support flange 5 has three wedges 11, 12 and 13, which are also equally spaced by 120° from each other. The cross sectional profile of each wedge 11, 12 and 13 (see wedge 11 in FIGS. 5 and 6) increases from a smaller radius R1, which is smaller than the bore radius $B_1$, steadily to a greater radius R2, which is greater than the bore radius $B_1$. Thereby the outline of the wedge 11 functions as a wedgelike tapered slope, which fits into the edge of groove 8 when the grinding ring 1 is rotated clockwise. All three wedges 11, 12 and 13 behave in this way. A clockwise rotation of the grinding ring 1 therefore causes the grinding ring 1 to make contact with all three wedge outlines and, to slip into the centered position shown in FIG. 5. When in this position, the grinding ring is locked into position by tightening the clamping flange 2.

The further solution illustrated in FIGS. 5 and 6 also allows easy sliding on with much tolerance, as illustrated in FIG. 6, whereby exact centering is made possible, without requiring that the supporting portion 3 of the support flange 5 have a tight concentrical fit in the grinding ring borehole 7. Rather, the tight "fit" results in required centering between the increasing outlines of the wedges 11, 12 and 13, and the edges of the grooves 8, respectively. In this way, it is made possible to utilize grinding rings 1 having relatively great radial tolerances to the grinding ring boreholes 7. Such grinding disks are less expensive to produce than conventional grinding disks, because their boreholes can have greater radial tolerances.

In FIG. 6, the rotational direction of the clamping device is indicated with the arrow 15. It is advantageous that the tapered outline of the wedges increases in opposite direction of the rotational direction according to arrow 15, so that, for instance, the smaller radius R1 comes first on the wedge 11.

The increase of the wedge outline from the smaller radius R1 to the larger radius R2 can be realized in various ways. Principally, even a linear increase is possible. A functionally especially efficient solution is illustrated in FIG. 6. According to it, the outline of the wedge 11 is in the shape of a circular arc, whereby, however, the center of the curvature M2 of the circular arc having a radius R is shifted laterally by an eccentricity x from the center M1 of the supporting portion 3 of the support flange 5.

In summary, the present invention is directed to a clamping device for a grinding ring with a clamping flange and a support flange, of which the supporting portion is provided along its length with radially protruding wedges, to which are assigned corresponding grooves in the borehole of the grinding ring, in which the radius ($D_1$) which encloses the wedges (9), is only a little smaller than the radius of the bore ($B_1$) of the grinding ring (1). Generally, over the circumference, three evenly spaced wedges (9) are provided. Typically, the difference of the radii ($D_1$; $B_1$) is a maximum of 5 $\mu$m.

In one embodiment of the invention, the present clamping device is a clamping device for a grinding ring with a clamping flange and a support flange, of which the supporting portion, along its length, is provided with radially protruding wedges, whereby said wedges are assigned to corresponding grooves in the borehole of the grinding ring, in which the cross sectional profile of each wedge (11, 12, 13) steadily increases from a smaller radius (R1), which is smaller than the radius of the borehole ($B_1$) of the grinding ring (1), to a larger radius (R2), which is greater than the radius of the borehole ($B_1$). In this embodiment, typically each wedge (11, 12, 13) increases from a smaller radius (R1) to a greater radius (R2) in the outline of the shape of a circular arc of the radius (R), whereby the center of the curvature (M2) is shifted laterally by an eccentricity (x) from the center (M1) of the supporting portion (3) of the support flange (5). Also, in this embodiment, preferably the outline of each wedge (11, 12, 13) increases in opposite direction to the rotational direction (15) of the supporting portion (3).

In general, the three wedges (11, 12, 13) are evenly spaced over the circumference of the supporting portion (3) of the support flange (5).

It thus will be seen that there is provided a clamping device for a grinding ring attains the various objects of the invention, and is well adapted for conditions of practical use. As numerous alternatives within the scope of the present invention will occur to those skilled in the art, besides those alternatives, equivalents, variations and modifications mentioned supra and shown in the appended drawings, it will be understood that the present invention is not to be limited solely by or to the recitations in the appended claims, but extends fully to all such equivalents and alternatives, both structural and functional.

I claim:

1. A grinding apparatus, for utilization on a grinding machine in which solid material is removed from a surface of a solid body by the rotary motion of a grinding disk, which comprises:

(a) a rotatable rectilinear driving shaft;

(b) a support flange, said support flange being mounted to said driving shaft and having an outer flat ring-shaped planar clamping surface, said clamping surface being oriented at a substantially right angle to the central longitudinal axis of said driving shaft;

(c) a clamping flange, said clamping flange being juxtaposed with and spaced from the clamping surface of said support flange;

(d) a generally circular grinding ring, said grinding ring being interposed between said clamping flange and said support flange, at least the outer edge of said grinding ring being composed of an abrasive material which is capable of grinding and comminuting the surface of a solid body, by the rotary motion of said grinding ring, while concomitantly contiguously contacting said surface of said solid body with said abrasive material, said grinding ring having a central generally circular borehole, one face of said grinding ring being mounted on said clamping surface of said support flange, so that said grinding ring is oriented at a substantially right angle to said central longitudinal axis of said drive shaft;

(e) a generally circular supporting portion means, said supporting portion means constituting an outer portion of said support flange at or adjacent the terminal end of said driving shaft, and extending centrally between said clamping flange and said clamping surface of said support flange;

(f) a first interacting guiding means, said first guiding means being disposed on the outer annular surface of said supporting portion means;

(g) a second interacting guiding means, said second guiding means being disposed on the inner surface of said borehole of said grinding ring, so that said first and second guiding means cooperate and interact to allow and permit good balancing and faultless whirling of said grinding ring, when centrally mounted and clamped between said clamping flange and said support flange, with balanced spinning and rotation of said grinding ring in exactly circular motion; and (h) means to urge said clamping flange towards said support flange, so that said grinding ring is restrained and revolved in rotary motion about said central longitudinal axis of said driving shaft, when said driving shaft is rotated, said grinding ring being thereby detachably attached and fastened to said driving shaft.

2. The grinding apparatus of claim 1, in which the cooperating and interacting first and second guiding means of element (g) comprise a plurality of individual discrete pairs of cooperating first and second guiding means.

3. The grinding apparatus of claim 2, in which the number of individual discrete pairs of cooperating first and second guiding means is three.

4. The grinding apparatus of claim 2, in which the individual discrete pairs of cooperating first and second guiding means are uniformly spaced about the periphery of the supporting portion means element (e), so that the distance between adjacent pairs of cooperating first and second guiding means is substantially constant.

5. The grinding apparatus of claim 1, in which the abrasive material of element (d) comprises cubic boron nitride.

6. The grinding apparatus of claim 1, in which the abrasive material of element (d) is disposed on and about the outer periphery of said member (d), so that the abrasive material is a generally circular outer extension of said member (d).

7. The grinding apparatus of claim 1, in which the urging means element (h) comprises a plurality of screw means, each of said screw means extending through both the clamping flange and the supporting portion means of the support flange.

8. The grinding apparatus of claim 1, in which the first interacting guiding means element (f) comprises a plurality of spaced apart wedges, said wedges protruding radially from the outer annular surface of the supporting portion means, and the second interacting guiding means element (g) comprises a plurality of spaced apart inner grooves disposed in the inner surface of the borehole of the grinding ring, the cooperating and interacting first and second guiding means comprising a plurality of pairs of cooperating wedges and grooves, each of said spaced apart wedges cooperating with one corresponding inner groove, the outer edge of each of said wedges being curved with an arc curvature of a portion of a circle, so that said outer edges of said wedges are aligned along a common circular outer periphery of said supporting portion means, the radius of said common circular outer periphery of said supporting portion means being smaller than the radius of the central borehole of the grinding ring by a minimal amount, so that said wedges and the inner surface of the central borehole are contiguous in the final assembled grinding apparatus.

9. The grinding apparatus of claim 8, in which the difference between the radius of the common circular outer periphery and the radius of the central borehole of the grinding ring is a maximum of 5 $\mu$m.

10. The grinding apparatus of claim 8, in which at least one lateral edge of each of said wedges is bevelled.

11. The grinding apparatus of claim 8, in which both of the opposed lateral edges of each of said wedges is bevelled.

12. The grinding apparatus of claim 1, in which the first interacting guiding means element (f) comprises a plurality of spaced apart wedges, said wedges protruding radially from the outer annular surface of the supporting portion means, and the second interacting guiding means element (g) comprises a plurality of spaced apart inner grooves disposed in the inner surface of the borehole of the grinding ring, the cooperating and interacting first and second guiding means comprising a plurality of pairs of cooperating wedges and grooves, each of said spaced apart wedges cooperating with one corresponding inner groove, the cross-sectional profile of each said wedges being tapered, so that the outer periphery of each of said wedges is sloped, such that the radius of the supporting portion means, from the center of the supporting portion means to the outer periphery of each of said wedges, steadily increases from a smaller radius, which is smaller than the radius of the central borehole in the grinding ring, to a greater radius, which is greater than the radius of the central borehole in the grinding ring, whereby said wedges have increasing outlines of tapered cross-sectional profiles, so that each of said wedges fits as a wedge-shaped sloped element into the edge of one corresponding inner groove, whereby the grinding ring, being controlled by said wedge-shaped sloped elements, is cammed and slides into an exact centering position, said wedges being aligned in tandem about the outer periphery of the supporting portion means.

13. The grinding apparatus of claim 12, in which the outer edge of each of the wedges is curved with an arc curvature of a portion of a circle.

14. The grinding apparatus of claim 13, in which the center of curvature of the arc curvature of the outer edge of each of the wedges is displaced and shifted laterally, and by an eccentricity, from the center of the supporting portion means.

15. The grinding apparatus of claim 12, in which the tapered outline of each wedge increases in cross-sectional profile against, and in opposite direction to, the rotational direction of the supporting portion means.

* * * * *